United States Patent [19]

Owen

[11] Patent Number: 4,527,098

[45] Date of Patent: Jul. 2, 1985

[54] DISCRETE STARTER FOR HID LAMP

[75] Inventor: Daniel V. Owen, Hendersonville, N.C.

[73] Assignee: General Electric Company, Schenectady, N.Y.

[21] Appl. No.: 461,829

[22] Filed: Jan. 28, 1983

[51] Int. Cl.[3] ..... H05B 37/00; H05B 39/00; H05B 41/14

[52] U.S. Cl. ..... 315/290; 361/400; 361/404; 315/DIG. 7; 315/289; 315/276

[58] Field of Search ..... 361/397, 400, 404; 315/DIG. 7, 276, 289, 290, 205, 209, DIG. 5

[56] References Cited

U.S. PATENT DOCUMENTS

| | | | |
|---|---|---|---|
| 3,508,112 | 4/1970 | Peek | 315/289 |
| 3,679,936 | 7/1972 | Moerkens | 315/205 |
| 3,917,976 | 11/1975 | Nuckolls | 315/258 |
| 4,249,229 | 2/1981 | Hester | 361/400 |
| 4,339,695 | 7/1982 | Siglock | 315/276 |
| 4,403,173 | 9/1983 | Mayer | 315/289 |
| 4,415,837 | 11/1983 | Sodini | 315/276 |
| 4,441,056 | 4/1984 | Siglock | 315/276 |
| 4,461,982 | 7/1984 | Fahnrich | 315/276 |

FOREIGN PATENT DOCUMENTS

| | | | |
|---|---|---|---|
| 2732761 | 1/1979 | Fed. Rep. of Germany | 361/397 |

*Primary Examiner*—Saxfield Chatmon

*Attorney, Agent, or Firm*—Ernest W. Legree; Philip L. Schlamp; Fred Jacob

[57] ABSTRACT

A discrete type starter for HID lamps uses a ferrite core pulse transformer whose secondary is connected in series with the lamp across a ballast output winding. The primary is formed by mounting one or more sidacs and a resistor astride the core loop and interconnecting them by cladding on the board to make two or three turns around the core. The primary is connected across a capacitor which is connected in series with an impedance across the ballast output winding.

6 Claims, 3 Drawing Figures

DISCRETE STARTER FOR HID LAMP

The invention relates to a discrete starter for a discharge lamp for use with a ballast not having a tapped coil on the output side.

BACKGROUND

Some high intensity discharge lamps utilizing metal vapors as the discharge medium require a starting voltage much higher than the operating voltage and this is particularly so with high pressure sodium vapor lamps. For such lamps starting aids have become available which are combined with otherwise conventional ballasts to generate a series of high frequency pulses which initiate the breakdown in the lamp.

One very effective starting aid is described in U.S. Pat. No. 3,917,976—Nuckolls, Starting and Operating Circuit for Gaseous Discharge Lamps. It comprises a charging capacitor and a voltage sensitive switch device such as a sidac which are connected to form a series discharge loop with a number of turns at the output end of the ballast. This means that the output or secondary side of the ballast must have a tap giving access to some of the end turns and this is not always feasible or practical. In such case a discrete or remote type starter aid must be used.

In the case of series ballasts for street lighting connected in a current loop regulated by a moving core constant current transformer, heavy insulation is required between the windings and the core. This makes the coupling poor at high frequencies and the provision of a properly insulated tap difficult. Also the secondary of the series ballast does not have very many turns, and to use it as a pulse transformer may place excessive voltage stress on the insulation between turns. Hence it is generally desirable to use a discrete starting aid with series ballasts.

Discrete starters are also used in installations where the ballast is located at some distance from the lamp. Examples are freezer lockers where the ballast and its attendant heat losses are kept out of the cold compartment in which the lamp is installed, and outdoor lighting fixtures using slender poles where the ballast is located at the base of the pole in order to keep the weight down. Since the starting pulses have a fast rise time and contain high frequencies, they are rapidly attenuated in the transmission from ballast to lamp. Accordingly for such installations discrete starters are preferably utilized.

In a discrete starter, a pulse transformer is provided whose secondary is connected in series with the lamp across the ballast secondary terminals. The primary of the pulse transformer is connected in series with a voltage breakdown device across a capacitor, and circuit means are provided to charge the capacitor. When the device breaks down, the rush of current through the primary generates a high voltage low energy pulse in the secondary of the pulse transformer. The pulse is applied in series with the ballast secondary voltage across the lamp electrodes. After the lamp has started, the ballast secondary voltage is no longer high enough to cause breakdown in the device and the starting circuit becomes quiescent. Such circuits are well-known and have been described in U.S. Pat. No. 3,235,769—Wattenbach.

SUMMRY OF THE INVENTION

The object of the invention is to provide an improved discrete type starter for high intensity discharge lamps which is reliable, low in cost and easy to manufacture.

In a starter embodying the invention, a pulse transformer has a core of magnetic material possessing good high frequency characteristics by reason of low eddy current and hysteresis losses, such as ferrite. It has a secondary winding of many turns intended for connection in series with the discharge lamp, and a primary of just a few turns. The primary is connected in series with at least one voltage breakdown device such as a sidac, across a capacitor. The capacitor is connected in series with an impedance in a charging circuit intended for connection across the lamp.

According to a feature of the invention, the starting aid components are mounted on a printed circuit board and interconnected by means of conductive cladding on the board. According to another feature, the primary winding is formed at least in part by mounting the breakdown device astride the ferrite core loop so that together with cladding in the circuitboard, it forms a turn around the core.

In one preferred embodiment of the invention, the primary comprises two turns and they are formed by mounting a sidac and a resistor transversely astride the core loop and connecting them in series by means of cladding on the board. In another preferred embodiment, the primary comprises three turns and they are formed by mounting two sidacs and a resistor transversely astride the core loop and connecting them all in series by means of the cladding.

DESCRIPTION OF DRAWINGS

FIG. 2 is a pictorial view of the printed circuit bort of the starter with only the components forming the primary wired in.

DETAILED DESCRIPTION

Figure 1:
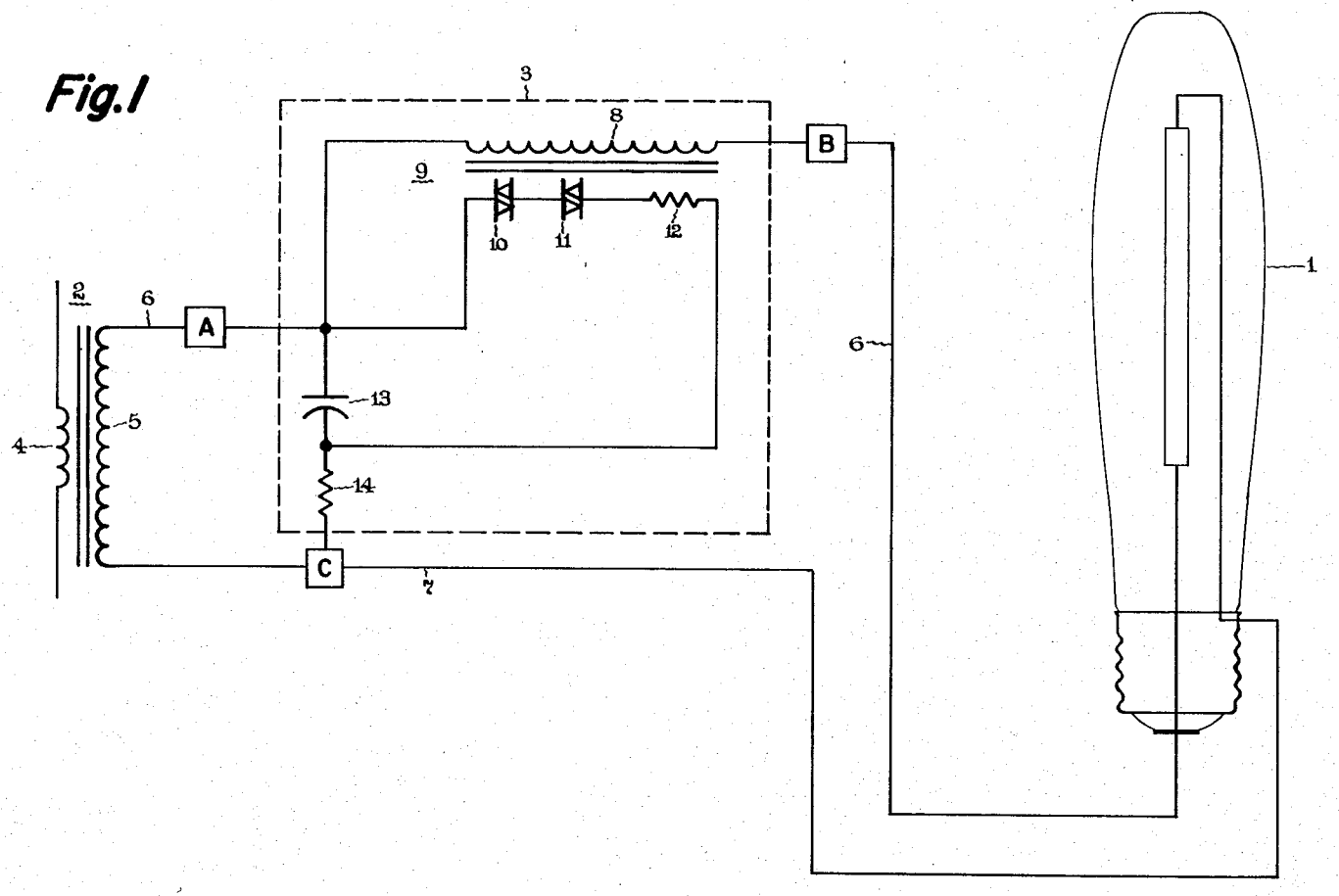
FIG. 1 is a schematic diagram of a series ballast lamp operating circuit including the discrete starter of the invention.

Referring now to the drawings and particularly to FIG. 1, there is shown schematically a circuit for starting and operating a high intensity discharge lamp 1 by a series type ballast 2 and a discrete starting aid 3 which comprises the components shown within the dotted rectangle. The illustrated lamp is a high pressure sodium vapor lamp. By way of example, in a 400 watt size, such a lamp operates on a current of about 4 amperes with an arc voltge drop from 100 to 140 volts, but requires a momentary voltage of 2 to 3 kilovolts to ignite and start. The starter 3 applies low energy high voltage pulses in series with the ballast secondary voltage to start the lamp.

Ballast 2 is a series type high leakage reactance transformer comprising a primary winding 4 which is usually designed for either a 6.6 ampere or a 20 ampere current. In a typical series street lighting installation, 50 or more such ballasts have their primaries connected in a line loop supplied by a moving core constant current transformer (not shown) of 20 to 50 KVA rating. The lamp 1 is connected across secondary winding 5 by conductors 6, 7, with conductor 6 interrupted by the series insertion of the secondary 8 of pulse transformer 9 in starter 3 between terminals A and B. Due to the presence of relatively high voltage to ground in the line loop, the windings of ballast 2 are heavily insulated and, as previously stated, this makes it necessary to resort to a discrete starter 3 for igniting the lamp. The primary of the pulse transformer comprises two sidacs 10,11 and a resistor 12 connected in series across capacitor 13 to form a discharge circuit. The capacitor is connected in series with resistor 14 in a charging circuit which is connected across the ballast secondary in parallel with the lamp between terminals A and C.

Figure 2:
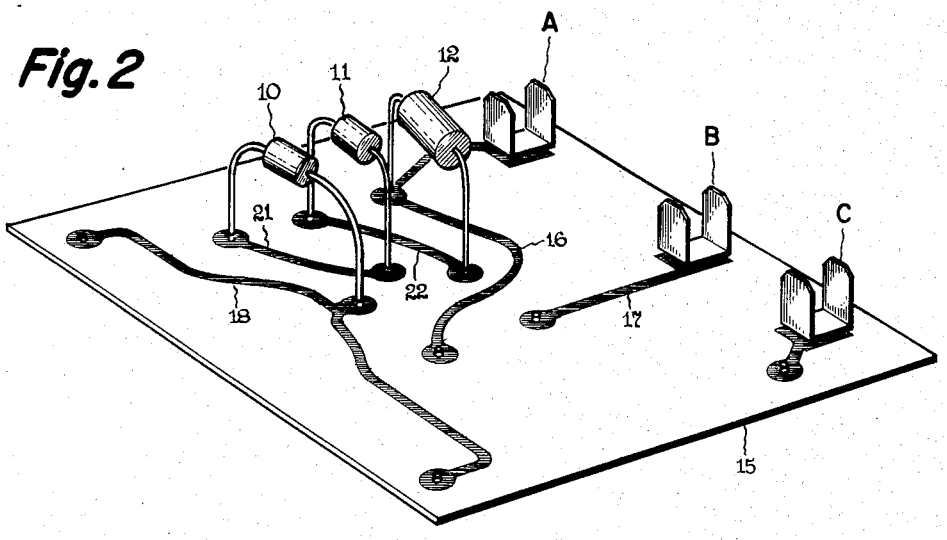
Figure 3:
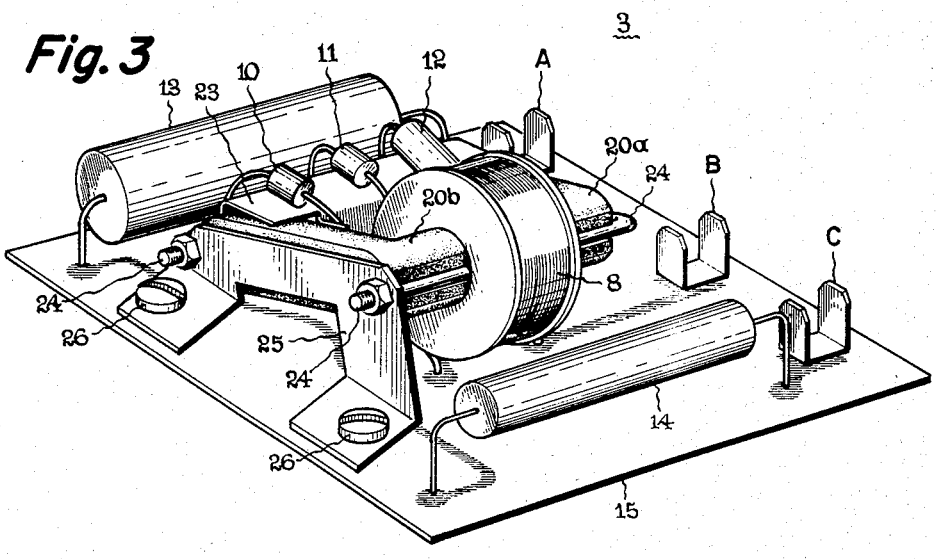
FIG. 3 is a pictorial view of the fully assembled starter on the printed circuit board.

Referring to FIGS. 2 and 3, the invention is more directly concerned with the physical arrangement and mounting of the starter components on circuit board 15. The board itself is of a rigid plastic material conventionally used for such purposes, for instance a glass-fiber-filled polyester resin or other suitable plastic. It is conductively clad on the back side to effect the interconnections of circuit components relative to the three terminals A, B and C in accordance with the schematic diagram. The conductive strips of cladding may be applied in conventional manner by first cladding the entire back side of the board with copper or an alloy suitable for soldering, next coating the cladding with resist in a manner defining conductive strips to be retained, then etching away all uncoated cladding, and finally removing the resist from the retained strips. The board is punched through wherever a lead from a component is to be connected to a strip. The components are mounted by entering their leads into the punched holes, cutting off any excess and bending the short stub ends of the leads on the back side of the board. After all components have been mounted, the leads are all soldered to the strip at one time by a solder bath dip.

Secondary winding 8 of the pulse transformer is connected between terminals A and B by soldering its leads into the ends of strips 16 and 17 which are joined to terminals A and B respectively. Capacitor 13 is connected to strip 16 and thereby to terminal A on one side, and is connected to strip 18 on the other side. Resistor 14 is connected to strip 18 on one side and to strip 19 joined to terminal C on the other, thus completing the charging circuit for capacitor 13 between terminals A and C.

The primary winding of the pulse transformer has three turns in the illustrated embodiment. They are formed by mounting sidacs 10 and 11 and resistor 12 astride the ferrite core loop 20 of the pulse transformer, and soldering their ends to strips 18 and 21, to strips 21 and 22, and to strips 22 and 16 respectively, as best seen in FIG. 2. Thus each element and an associated strip form a loop around the ferrite core. Paper shield 23 prevents any contact between the sidac or resistor leads and the core. As shown in FIG. 3, the core consists of a U-shaped part 20*a* and an I-shaped part 20*b*. Two U-shaped parts could equally well be used. The parts are bound and held together by a clamp 24 fitting in a channel or groove molded in the outside of their short sides. The parts come together under the primary turns and under the secondary winding 8 to complete the magnetic circuit. The core parts are attached by clamp 24 to bracket 25 which in turn is fastened by screws 26 to the circuit board.

In operation, capacitor 13 charges through resistor 14 on each half cycle. As the voltage across the capacitor rises, it reaches the breakdown voltage of the two sidacs in series. When this occurs, the voltage on the capacitor is suddenly impressed across the three primary turns of the pulse transformer. The secondary 8 of the pulse transformer may have 40 turns so that the turns ratio is 40/3. Assuming a breakdown voltage of 220 volts for the two sidacs in series, the current surge as the capacitor discharges through the primary will produce a voltage pulse in the secondary stepped up by the turns ratio to almost 3000 volts peak. After the lamp has started, the voltage drop across it in operation is insufficient to break down the sidacs and the circuit remains quiescent. Also the lamp current flowing through the secondary turns of the pulse transformer causes saturation of the ferrite core. As a result the voltage drop across the secondary of the pulse transformer is small during the lamp operation and has negligible effect on lamp output.

By way of examples of component values suitable for use with the invention, for 400 and 250 watt HPS lamps which require a ballast having a high secondary voltage, two sidacs are used in series; capacitor 13 is 0.22 mfd, resistor 12 is 6.8 ohms, the secondary has 40 turns and the two sidacs plus the resistor make 3 primary turns. For HPS lamps of 150, 100, 70 or 50 watts, only one sidac is used and resistor 12 is 4.7 ohms; the secondary may have 60 or 66 turns and the single sidac plus the resistor make 2 primary turns.

The invention thus provides a circuit board mounting of a discrete type starter for HID lamps which is reliable, low in component cost and easily assembled. The particular embodiment with a preferred choice and arrangement of component parts which has been illustrated and described is intended by way of example, and numerous modifications may be made by those skilled in the art without departing from the scope of the invention. The appended claims are intended to cover all such variations as come within the true spirit and scope of the invention.

What I claim as new and desire to secure by Letters Patent of the United States is:

1. A discrete starter for starting a discharge lamp by high voltage pulses, said starter being of the kind comprising a pulse transformer having a secondary for connection in series with the lamp across a ballast output circuit and a primary connected in series with a voltage breakdown device across a capacitor, said capacitor and a series impedance forming a charging circuit for connection across the ballast output circuit, comprising:

a printed circuit board having three terminals and conductive strips thereon for making connections thereto, a pulse transformer having a core of magnetic material making a closed loop fastened to said board, said transformer having on said core a secondary winding of many turns connected between a first and a second of said terminals, a capacitor and an impedance connected in series from said first to a third of said terminals, and a voltage breakdown device mounted transversely astride said core and connected to conductive strips in said board to form at least one primary turn around said core connected across said capacitor, the current surge through said primary turn when said device breaks down producing high voltage pulses in said secondary.

2. A starter as in claim 1 wherein said voltage breakdown device is a sidac.

3. A starter as in claim 1 wherein said voltage breakdown device is a sidac, and wherein a resistor is also mounted transversely astride said core and connected in series with said sidac by means of a conductive strip in said board to form two primary turns around said core which are connected across said capacitor.

4. A starter as in claim 1 wherein said voltage breakdown device is a sidac, and wherein a second sidac and also a resistor are mounted transversely astride said core and connected in series by means of conductive strips in said board to form three primary turns around said core which are connected across said capacitor.

5. A starter as in claim 1 wherein said core is of ferrite.

6. A starter as in claim 1 wherein the impedance connected in series with said capacitor to form a charging circuit is a resistance.

* * * * *